US008244164B2

(12) United States Patent
Saito et al.

(10) Patent No.: US 8,244,164 B2
(45) Date of Patent: Aug. 14, 2012

(54) IMAGE FORMING APPARATUS WITH TWO DEVELOPING ROLLERS, AND AN ELECTRODE THEREBETWEEN

(75) Inventors: Hiroyuki Saito, Tokyo (JP); Seiko Itagaki, Tokyo (JP); Hiroshi Akita, Tokyo (JP); Natsuko Minegishi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 150 days.

(21) Appl. No.: 12/574,725

(22) Filed: Oct. 7, 2009

(65) Prior Publication Data

US 2010/0086323 A1 Apr. 8, 2010

(30) Foreign Application Priority Data

Oct. 8, 2008 (JP) ..... 2008-261508

(51) Int. Cl.
*G03G 15/08* (2006.01)

(52) U.S. Cl. ..... 399/269

(58) Field of Classification Search ..... 399/55, 399/269, 270, 271
See application file for complete search history.

(56) References Cited

U.S. PATENT DOCUMENTS

| | | | | | |
|---|---|---|---|---|---|
| 3,638,614 | A | * | 2/1972 | Young et al. | 399/269 |
| 4,015,561 | A | * | 4/1977 | Howard et al. | 399/269 |
| 4,050,413 | A | * | 9/1977 | Parker | 399/254 |
| 4,431,296 | A | * | 2/1984 | Haneda et al. | 399/266 |
| 4,553,827 | A | * | 11/1985 | Mayer | 399/269 |
| 5,557,371 | A | * | 9/1996 | Tooda | 399/159 |
| 5,911,098 | A | * | 6/1999 | Gyotoku et al. | 399/264 |
| 7,519,318 | B2 | * | 4/2009 | Kurogawa et al. | 399/269 |
| 2006/0222390 | A1 | * | 10/2006 | Sasaki et al. | 399/55 |

FOREIGN PATENT DOCUMENTS

| | | | |
|---|---|---|---|
| JP | 61053659 | A * | 3/1986 |
| JP | 61053674 | A * | 3/1986 |
| JP | 7-325466 | | 12/1995 |
| JP | 10312110 | | 11/1998 |
| JP | 2003-302826 | | 10/2003 |
| JP | 2006139227 | | 6/2006 |

OTHER PUBLICATIONS

Japanese Office Action mail dated Sep. 14, 2010 (2 pages) with English language Translation of Japanese Office Action (4 pages).

* cited by examiner

*Primary Examiner* — Robert Beatty
(74) *Attorney, Agent, or Firm* — Lucas & Mercanti, LLP

(57) ABSTRACT

An image forming apparatus includes: a supplying section for supplying developer; a first developing roller including plural magnetic poles and a first sleeve arranged rotatable to the first developing roller; a second developing roller including plural magnetic poles and a second sleeve arranged rotatable to the second developing roller, the second developing roller arranged adjacent to the first developing roller and parallel to the same; an electrode arranged between the first and second developing rollers; and a voltage applying unit for applying bias voltages each having different electric potential corresponding to the first developing roller, the second developing roller and the electrode, wherein an absolute value of the bias voltage to be applied to the electrode is larger than that of the bias voltage to be applied to the first developing roller and smaller than that of the bias voltage to be applied to the second developing roller.

4 Claims, 8 Drawing Sheets

FIG. 8

| NUMBER OF SHEET | WORKING EXAMPLE | | | | | | COMPARATIVE EXAMPLE | | | |
|---|---|---|---|---|---|---|---|---|---|---|
| | WIRE SHAPED ELECTRODE | | PLEXIFORMED ELECTRODE | | PLATE-LIKE ELECTRODE | | COMPARATIVE EXAMPLE WITH ELECTRODES (UNIPOTENTIAL BIAS VOLTAGE IS APPLIED) | | COMPARATIVE EXAMPLE WITHOUT ELECTRODES (UNIPOTENTIAL BIAS VOLTAGE IS APPLIED) | |
| | REFLECTION DENSITY | GRAININESS | REFLECTION DENSITY | GRAININESS | REFLECTION DENSITY | GRAININESS | REFLECTION DENSITY | GRAININESS | REFLECTION DENSITY | GRAININESS |
| 0 | 0.05 | GOOD | 0.05 | GOOD | 0.05 | GOOD | 0.05 | GOOD | 0.05 | GOOD |
| 100 | 0.06 | GOOD | 0.06 | GOOD | 0.07 | GOOD | 0.65 | BAD | 0.55 | BAD |

*FIG. 9*

| NUMBER OF SHEET | WORKING EXAMPLE | | COMPARATIVE EXAMPLE | | | |
|---|---|---|---|---|---|---|
| | IN THE PRESENCE OF TRAVELING WAVE ELECTRIC FIELD | | COMPARATIVE EXAMPLE WITH ELECTRODES (UNIPOTENTIAL BIAS VOLTAGE IS APPLIED) | | COMPARATIVE EXAMPLE WITHOUT ELECTRODES (UNIPOTENTIAL BIAS VOLTAGE IS APPLIED) | |
| | REFLECTION DENSITY | GRAININESS | REFLECTION DENSITY | GRAININESS | REFLECTION DENSITY | GRAININESS |
| 0 | 0.05 | GOOD | 0.05 | GOOD | 0.05 | GOOD |
| 100 | 0.05 | GOOD | 0.65 | BAD | 0.55 | BAD |

IMAGE FORMING APPARATUS WITH TWO DEVELOPING ROLLERS, AND AN ELECTRODE THEREBETWEEN

BACKGROUND OF THE INVENTION

1. Field of the Invention

The present invention relates to an image forming apparatus.

2. Description of Related Art

Recently, an image forming apparatus having two developing rollers in a developing area so as to keep good developing performance is proposed along with faster image forming processing. Here, the developing performance means performance to develop right amount of toner and to avoid bad image forming occurred by fog of background density, beads carry over or the like.

If the two developing rollers are arranged in the developing area, a developer flows through a flow path, which goes in a single direction through a supplying section for supplying the developer, a regulating section for regulating flow rate of the developer, first and second developing rollers each for developing toner image to a latent image carrier, and a retrieve section for retrieving developer remained on the second developing roller after a development.

Here, the regulating section is generally located not adjacent to the second developing roller to which the developer is supplied from the first developing roller but adjacent to the first developing roller. That is because, if two regulating sections are respectively arranged adjacent to the first and second developing rollers, such problems may occur that a developing apparatus significantly grows in size or deterioration of the developer may be accelerated.

For the first developing roller, locating the regulating section has a merit that the toner adhered on a surface of the first developing roller is removed. To put it concretely, the remaining toner on a sleeve, which is rotatably arranged on a surface of the first developing roller, is removed by a developer chamber, which is formed by the regulating section and scrapes against the sleeve.

On the other hand, toner pollution occurs on a sleeve of the second developing roller for the reason that a developer chamber is not formed because the regulating section is not located adjacent to the second developing roller. Progression of the toner pollution causes bad image forming such as color cast in a foundation or decrease in concentration, which finally leads to reduction of the developing performance.

For the image forming apparatus having two developing rollers, how to resolve the toner pollution on the sleeve of the second developing roller is a problem to keep good developing performance.

Japanese Patent Application Laid-Open publication No. 2006-139227 discloses a technique for electrically displacing the toner adhered on the sleeve of the second developing roller to the latent image carrier or to the first developing roller in a toner removing mode.

Moreover, Japanese Patent Application Laid-Open publication No. 10-312110 discloses a technique for electrically flying the toner adhered on the sleeve of a developing roller to a conductive roller and removing the toner on the conductive roller by a blade.

However, the technique disclosed in Japanese Patent Application Laid-Open Publication No. 2006-139227 cannot remove the tanner adhered on the sleeve of the second developing roller without being shifted to a particular mode such as the toner removing mode.

Moreover, in the technique disclosed in Japanese Patent Application Laid-Open Publication No. 10-312110, removal effect gradually deteriorates because making the blade to be contacted with the conductive roller leads the toner adhered on the conductive roller.

SUMMARY OF THE INVENTION

It is, therefore, a main object of the present invention to provide an image forming apparatus, which can stably remove the toner adhered on the sleeve of the second developing roller effectively when developing.

According to a first aspect of the present invention, there is provided an image forming apparatus, including: a supplying section for supplying developer; a first developing roller including a plurality of magnetic poles and a first sleeve arranged rotatable to the first developing roller; a second developing roller including a plurality of magnetic poles and a second sleeve arranged rotatable to the second developing roller, the second developing roller arranged adjacent to the first developing roller and parallel to the same; an electrode arranged between the first and second developing rollers; and a voltage applying unit for applying bias voltages each having different electric potential corresponding to the first developing roller, the second developing roller and the electrode, wherein an absolute value of the bias voltage to be applied to the electrode is larger than an absolute value of the bias voltage to be applied to the first developing roller and smaller than an absolute value of the bias voltage to be applied to the second developing roller.

Preferably, the electrode is arranged along axes of the first and second developing rollers.

Preferably, the electrode is in the form of wire, mesh or plate.

Preferably, the electrode is composed of a plurality of small electrodes, and the voltage applying unit applies bias voltages each having phase that differs corresponding to each of the plurality of small electrodes.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 8 is a table showing a result of a performance assessment test to the image forming apparatus 100 according to the first embodiment of the present invention; and FIG. 9 is a table showing a result of a performance assessment test to the image forming apparatus 100 according to the second embodiment of the present invention.

DESCRIPTION OF THE PREFERRED EMBODIMENTS

In the following, the best modes for implementing the present invention are described with reference to the attached drawings. While various technically preferable features are described below, the scope of the invention is not limited to the following embodiments and illustrated examples.

First Embodiment

Figure 1:
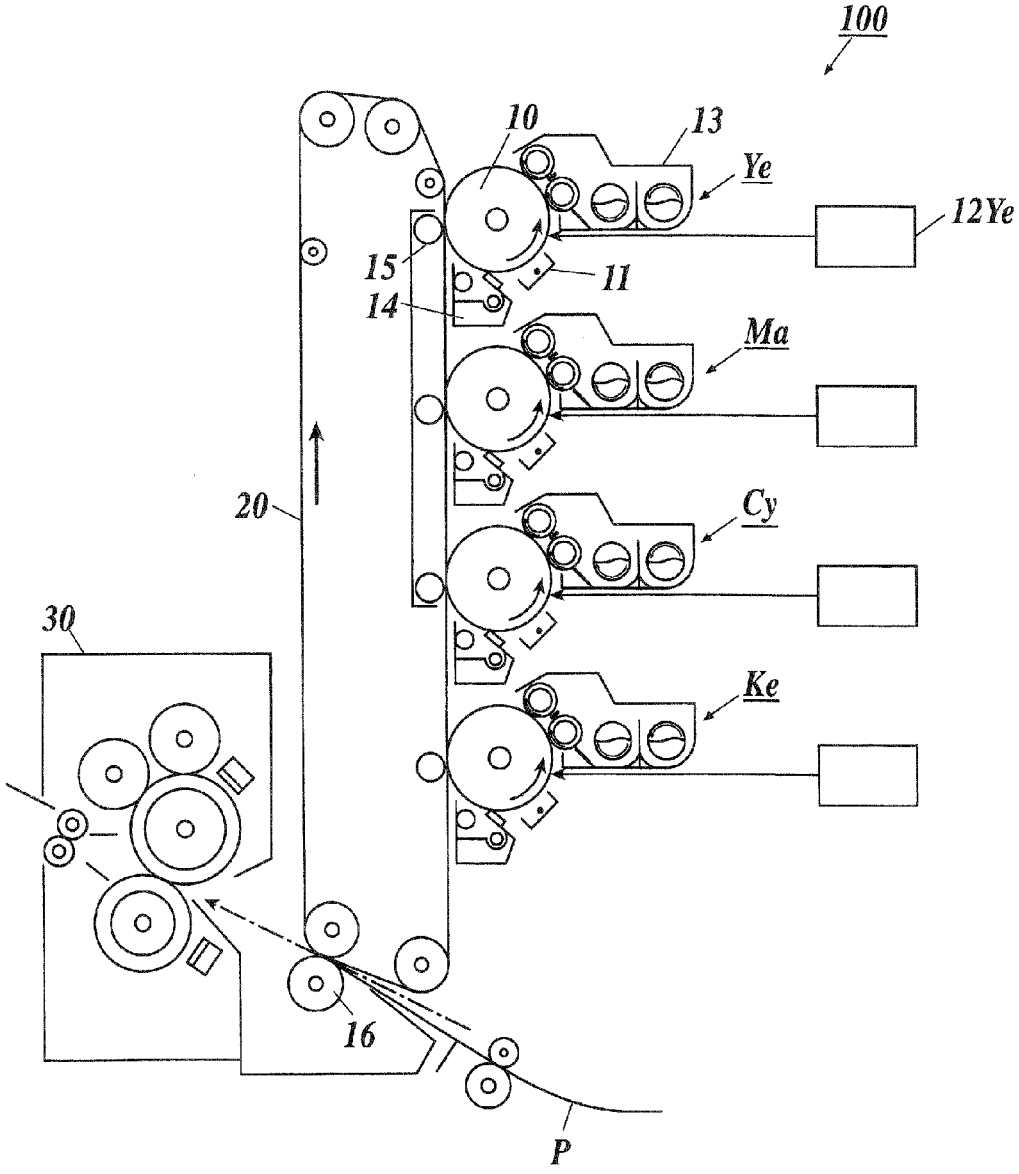
FIG. 1 is a block diagram showing a skeleton framework of an image forming apparatus according to a first embodiment of the present invention.

FIG. 1 is a block diagram showing a skeleton framework of an image forming apparatus 100 according to a first embodiment of the present invention.

The image forming apparatus 100 includes a yellow image forming section Ye, a magenta image forming section Ma, a cyan image forming section Cy and a black image forming section Ke. Each of the image forming sections Ye, Ma, Cy and Ke is arranged along a moving direction of an intermediate transcriptional body 20.

Each of the image forming sections Ye, Ma, Cy and Ke has the same configuration and function. Therefore, hereinafter, a configuration and a function of the yellow image forming section Ye will be described as an example.

The yellow image forming section Ye includes a photoreceptor 10, a charging device 11, an exposure device 12, a developing device 13, a cleaning device 14, a primary transcription roller 15 and the like. Each of the devices is arranged around the photoreceptor 10 along a rotational direction of the photoreceptor 10.

The charging device 11 uniformly charges a surface of the photoreceptor 10. The exposure device 12 exposes the charged photoreceptor 10 to form a latent image.

The developing device 13 develops the latent image formed by the exposure device 12 on the photoreceptor 10. Here, a detailed configuration and a motion of the developing device 13 will be described on and after FIG. 2 in the following.

The cleaning device 14 retrieves/removes a yellow toner, which is not transferred to the intermediate transcriptional body 20 and remains on the surface of the photoreceptor 10.

The primary transcription roller 15 transfers a yellow toner image formed on the photoreceptor 10 to the intermediate transcriptional body 20.

The intermediate transcriptional body 20 is formed in the shape of a belt and transports a monochrome/full color toner image formed on the intermediate transcriptional body 20 to a secondary transcription roller 16.

The secondary transcription roller 16 transfers the toner image transferred on the intermediate transcriptional body 20 to a sheet P. A fixing device 30 fixes the tanner image formed on the sheet P after transferring.

Figure 2:
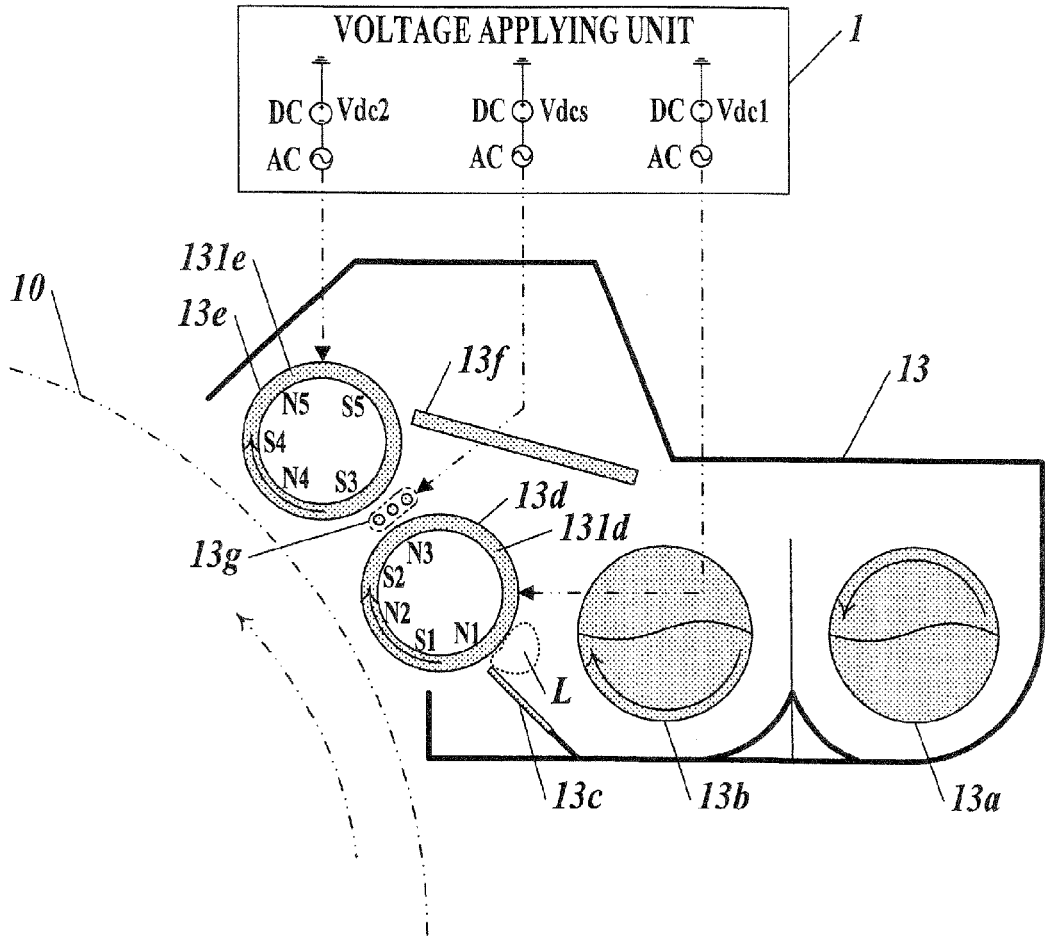
FIG. 2 is a block diagram showing a skeleton framework of a developing device according to the first embodiment of the present invention.

FIG. 2 shows a block diagram showing a skeleton framework of the developing device 13.

The developing device 13 includes an agitating section 13*a*, a supplying section 13*b*, a regulating section 13*c*, a first developing roller 13*d*, a second developing roller 13*e*, a retrieve section 13*f*, an electrode 13*g* and the like.

The agitating section 13*a* includes a screw and agitates nonmagnetic toner and magnetic carrier to be frictionally charged at a constant rate to generate a developer.

The supplying section 13*b* includes a screw and receives the developer from the agitating section 13*a* to supply the developer to the first developing roller 13*d* by the screw.

The regulating section 13*c* regulates a flow rate of the developer to be supplied from the supplying section 13*b* to the first developing roller 13*d*. Here, the regulating section 13*c* forms a developer chamber L by regulating the flow rate of the developer. The developer chamber L scrapes against a first sleeve 131*d* of the first developing roller 13*d* to remove the toner adhered on the first sleeve 131*d*.

The first developing roller 13*d* interiorly includes a plurality of magnetic poles and includes the first sleeve 131*d* arranged rotatable to a surface of the first developing roller 13*d*.

"N" and "S" shown in the figures represent polar characters, and different numbers in a same pole (for example, N1 and N2) represent that magnetic flux density [mT] is different. Here, a portion without magnetic pole may be a space or may be installed with a nonmagnetic member.

The first developing roller 13*d* carries the developer by the plurality of magnetic poles and by rotation of the first sleeve 131*d* to develop the latent image formed on the photoreceptor 10.

Moreover, the first developing roller 13*d* supplies the developer to the second developing roller 13*e*.

The second developing roller 13*e* has the same configuration as the first developing roller 13*d* except for locations of magnetic poles and magnetic flux density [mT] of each of the magnetic poles.

The second developing roller 13*e* receives the developer from the first developing roller 13*d* and develops the latent image formed on the photoreceptor 10 by using the received developer.

A toner image is formed on the photoreceptor 10 by the developing processing performed by the first developing roller 13*d* and the second developing roller 13*e*.

The retrieve section 13*f* retrieves the developer from the second developing roller 13*e*.

The electrode 13*g* is composed of such as tungsten or stainless steel (SUS) and arranged between the first developing roller 13*d* and the second developing roller 13*e*. Moreover, the electrode 13*g* extends along axes of the first developing roller 13*d* and the second developing roller 13*e*.

Figure 3:
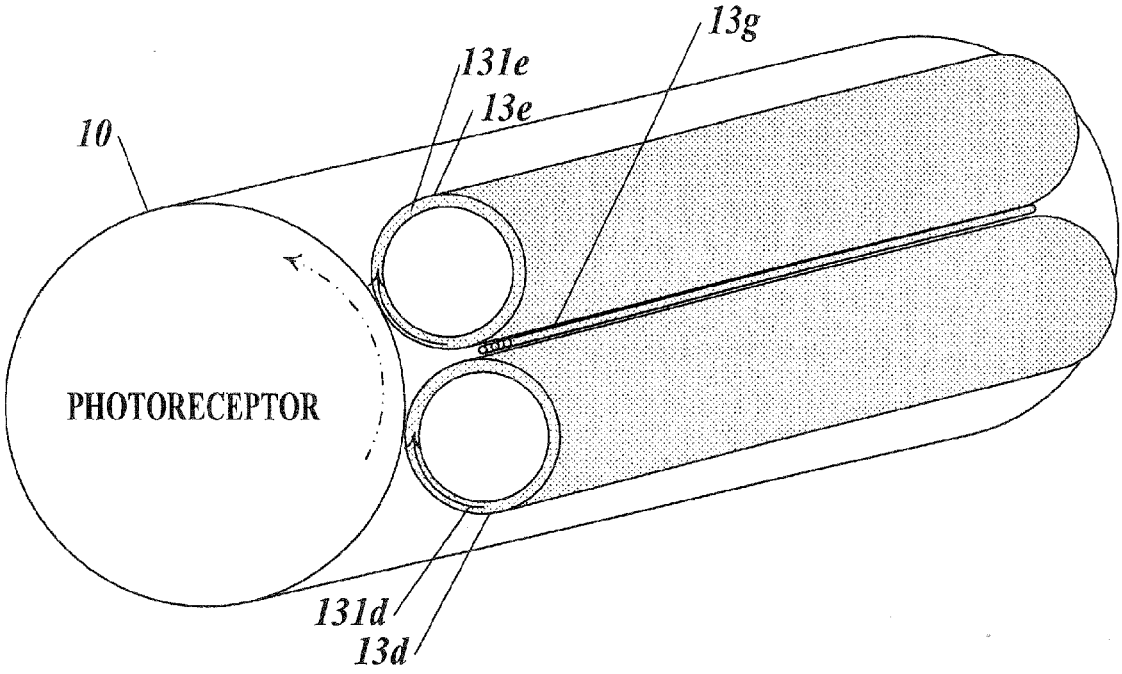
FIG. 3 is a perspective view showing positional relationship among an electrode, a first developing roller and a second developing roller.

FIG. 3 shows a perspective view showing positional relationship among the electrode 13*g*, the first developing roller 13*d* and the second developing roller 13*e*.

As shown in FIG. 3, the electrode 13*g* is composed of three small electrodes, which are in the form of wire and extend along axes of the first developing roller 13*d* and the second developing roller 13*e*. Incidentally, the number of the small electrodes in the form of wire is not limited to three. Moreover, the shape of the electrode 13*g* is not limited to be in the form of wire but may be in the form of mesh or plate.

A voltage applying unit 1 applies bias voltages each having different electric potential corresponding to the first developing roller 13*d*, the second developing roller 13*e* and the electrode 13*g*.

Absolute value of each bias voltage to be applied satisfies a relationship of $|Vdc1|<|Vdcs|<|Vdc2|$, in which Vdc1 represents bias voltage to be applied to the first developing roller 13*d*, Vdc2 represents bias voltage to be applied to the second developing roller 13*e* and Vdcs represents bias voltage to be applied to the electrode 13*g*.

Figure 4:
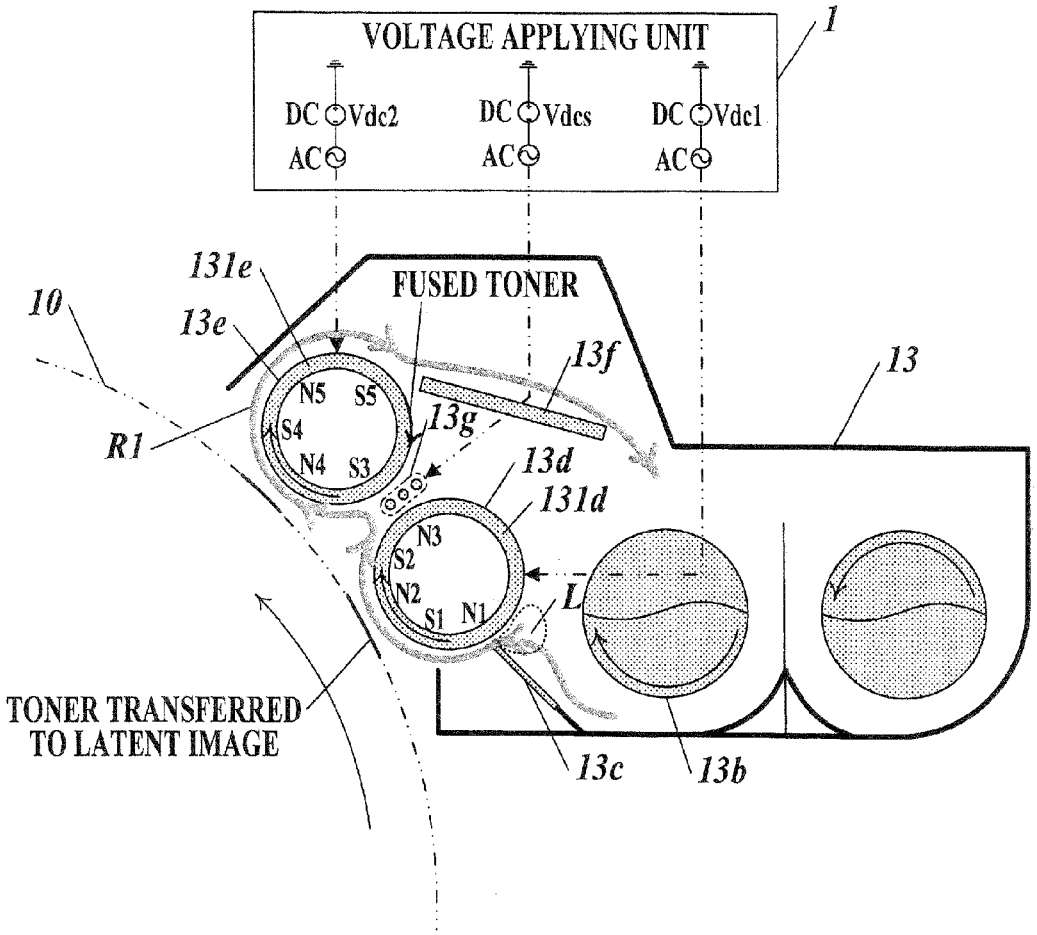
FIG. 4 is a diagram showing a flow path for a developer when in developing.

Next, a flow path for the developer at a time of development will be explained with reference to FIG. 4.

The developer flows from the supplying section 13*b* via the regulating section 13*c* to the first developing roller 13*d*.

At the first developing roller 13*d*, a part of the toner included in the developer is transferred to the latent image formed on the photoreceptor 10. Moreover, the developer flows from the first developing roller 13*d* to the second developing roller 13*e*.

At the second developing roller 13*e*, a part of the toner included in the developer is transferred to the latent image formed on the photoreceptor 10. Then, remaining developer, which does not contribute to the development, is retrieved by the retrieve section 13*f*. Here, a part of the tanner included in the developer is not retrieved by the retrieve section 13*f* to be adhered to the second sleeve 131*e*. The adhered tanner moves along with rotation of the second sleeve 131*e* and flows adjacent to the electrode 13*g*.

Figure 5:
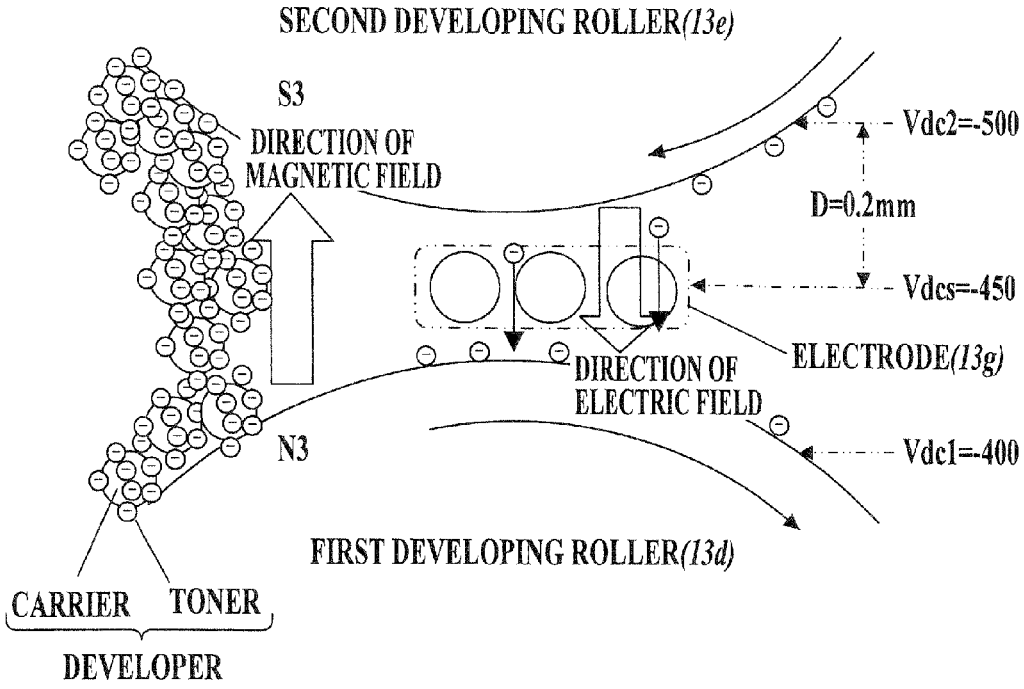
FIG. 5 is a diagram showing movement of the toner positioned adjacent to the electrode.

FIG. 5 shows a movement of the tanner positioned adjacent to the electrode 13*g*.

As shown in FIG. 5, bias voltages each having different electric potential are applied corresponding to the first developing roller 13*d*, the second developing roller 13*e* and the electrode 13*g* by the voltage applying unit 1. In this embodiment, the first developing roller 13*d* is applied with a bias voltage of Vdc1=−400 [V], the second developing roller 13*e* is applied with a bias voltage of Vdc2=−500 [V] and the electrode 13*g* is applied with a bias voltage of Vdcs=−450 [V].

In the neighborhood of the electrode 13*g*, an electric field is produced in a direction from the second developing roller 13*e* to the first developing roller 13*d* since electric potentials of the corresponding bias voltages to be applied are different from one another.

The tanner adhered to the second sleeve 131*e* transfers from the second developing roller 13*e* to the electrode 13*g* by the electric field, and further transfers from the electrode 13*g* to the first sleeve 131*d*.

Figure 6:
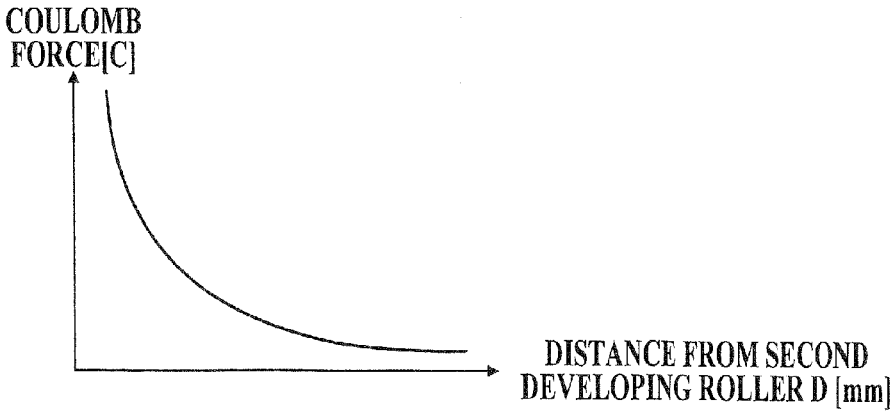
FIG. 6 is a diagram showing relationship between a coulomb force [C] exerted on the toner and a distance D from the second developing roller [mm]

As shown in FIG. 6, the electrode 13*g* needs to be installed at a position where distances from the first developing roller 13*d* and the second developing roller 13*e* are not too far because Coulomb force [C] exerted on the toner is inversely proportional to the distances D. In this embodiment, the distance D is 0.2 [mm].

The toner transferred from the second sleeve 131*e* via the electrode 13*g* to the first sleeve 131*d* moves along with a rotation of the first sleeve 131*d* to be exfoliated and to be removed from the first sleeve 131*d* by the developer chamber L. Alternatively, the toner transferred to the first sleeve 131*d* is removed by being flied from the first sleeve 131*d* by the magnetic field produced between the magnetic poles N1, N3 of the first developing roller 13*d*.

According to the above described configuration, it is possible to transfer the toner adhered to the second sleeve 131*e* of the second developing roller 13*e* to the first developing roller 13*d* during a normal image forming processing without shifting particular mode for removing the toner. That is, the toner adhered to the second developing roller 13*e* can be removed stably when in developing.

A result of a performance assessment test to the image forming apparatus 100 will be shown in FIG. 8.

Working Example

The performance assessment test for the image forming apparatus 100 has carried out on the cases in which the electrode 13*g* is configured in the form of wire, mesh or plate.

In the performance assessment test, a predetermined image is formed on each of 100,000 sheets, and then, reflection density and graininess are checked as to before and after an image formation. Regarding the graininess, visual judgment as to whether the printed image is rough or not is adopted as a criterion.

The working example gave results that, in any case where the electrode 13*g* is formed in the shape of wire, mesh or plate, the reflection density does not change much before and after the image formation and the graininess is good.

Comparative Example

A performance assessment test for an image forming apparatus has carried out as to a case where unipotential bias voltage is applied to the first developing roller 13*d*, the second developing roller 13*e* and the electrode 13*g* (hereinafter, called as comparative example with electrodes).

Moreover, a performance assessment test for an image forming apparatus has carried out as to a case where the electrode is removed (hereinafter, called as comparative example without electrodes).

The comparative example with electrodes gave results that the reflection density changes much from 0.05 to 0.65 around the image formation and the graininess becomes bad.

Moreover, the comparative example without electrodes gave results that the reflection density changes much and the graininess becomes bad as in the comparative example with electrodes.

As described above, according to the first embodiment, by arranging the electrode 13*g* between the first developing roller 13*d* and the second developing roller 13*e* and applying bias voltages each having different electric potential, the toner adhered to the second sleeve 131*e* can be transferred to the first sleeve 131*d* when in development. The toner adhered to the second sleeve 131*e* can be removed stably and effectively, and bad image forming caused by a toner pollution can be resolved.

Moreover, it is not necessary to shift to a particular mode such as a mode for removing the toner, and physical contact between a sleeve and a blade or the like does not occur.

Moreover, the electrode 13*g* may be shaped in any form of wire, mesh or plate, and same advantage to resolve toner pollution can be obtained in any case of shape of the electrode 13*g*.

Second Embodiment

Figure 7:
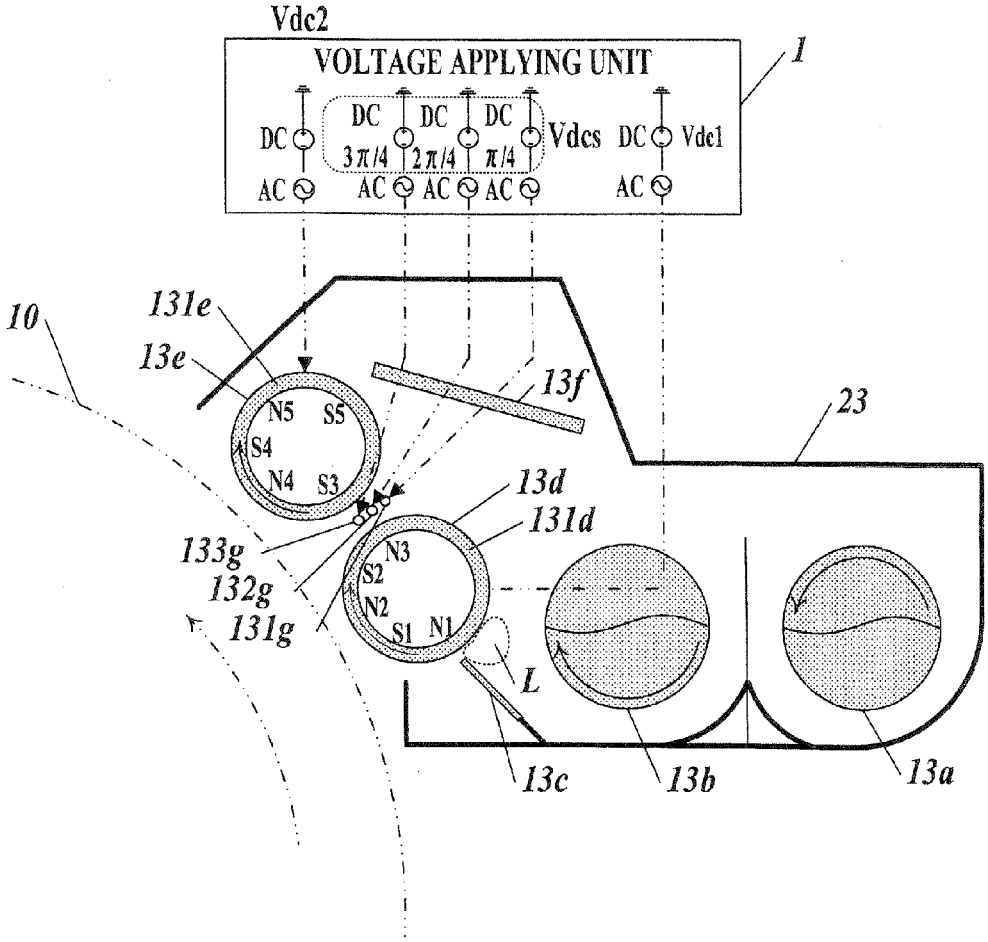
FIG. 7 is a block diagram showing a skeleton framework of a developing device according to a second embodiment of the present invention.

FIG. 7 shows a developing apparatus 23 according to a second embodiment of the present invention.

Here, the same sign will be assigned to parts, in which configuration and motion are the same as in the first embodiment and the explanation will be omitted.

The developing apparatus 23 includes small electrodes 131*g*, 132*g* and 133*g*. The small electrodes 131*g*-133*g* are connected to different power sources, respectively.

The voltage applying unit 1 applies bias voltages each having different phase corresponding to the small electrodes 131*g*-133*g*. Concretely, the voltage applying unit 1 applies bias voltage to each of the small electrodes 131*g*-133*g*, wherein each phase of the bias voltage is shifted by $\pi/4$. Here, each of the bias voltages to be applied corresponding to the small electrodes 131*g*-133*g* has the same electric potential.

Absolute value of each bias voltage to be applied corresponding to the first developing roller 13*d*, the second developing roller 13*e* and the small electrodes 131*g*-133*g* satisfies, as in the first embodiment, a relationship of

|Vdc1|<|Vdcs|<|Vdc2|, in which Vdcs represents bias voltage to be applied to the small electrodes 131*g*-133*g*.

The voltage applying unit 1 applies bias voltage that satisfies above relationship and is shifted by a predetermined phase. By doing so, an electric field directed from the small electrode 131*g* to the small electrode 133*g* (hereinafter, called as a traveling wave electric field) is produced as well as an electric field directed from the second developing roller 13*e* to the first developing roller 13*d*.

FIG. 9 shows a result of a performance assessment test to the image forming apparatus 100.

Working Example

The performance assessment test for the image forming apparatus 100 has carried out, in which the image forming apparatus 100 includes the developing apparatus 23 for producing the traveling wave electric field at the small electrodes 131*g*-133*g*.

In the performance assessment test, a predetermined image is formed on each of 100,000 sheets, and then, reflection density and graininess are checked as to before and after an image formation. Regarding the graininess, visual judgment as to whether the printed image is rough or not is adopted as a criterion.

The working example gave results that the reflection density does not change much before and after the image formation and the graininess is good.

Comparative Example

The comparative example with electrodes and the comparative example without electrodes each shown in FIG. 9 is the same as shown in FIG. 8, so the explanation will be omitted.

As described above, according to the second embodiment of the present invention, the traveling wave electric field can be produced by applying bias voltages each having different electric potential corresponding to the small electrodes 131*g*-133*g*.

By producing the traveling wave electric field, the toner adhered to the second sleeve 131*e* can be more strongly vibrated, and therefore, advantageous effect to remove the toner can be improved. Moreover, effectives for removing the toner to be adhered to the small electrodes 131*g*-133*g* can be proposed.

As above described, according to the embodiments of the present invention, the image forming apparatus 100 includes: a supplying section 13*b* for supplying developer; a first developing roller 13*d* including a plurality of magnetic poles and a first sleeve 131*d* arranged rotatable to the first developing roller 13*d*; a second developing roller 13*e* including a plurality of magnetic poles and a second sleeve 131*e* arranged rotatable to the second developing roller 13*e*, the second developing roller 13*e* arranged adjacent to the first developing roller 13*d* and parallel to the same; an electrode 13*g* arranged between the first and second developing rollers 13*d*, 13*e*; and a voltage applying unit 1 for applying bias voltages each having different electric potential corresponding to the first developing roller 13*d*, the second developing roller 13*e* and the electrode 13*g*, wherein an absolute value of the bias voltage to be applied to the electrode 13*g* is larger than an absolute value of the bias voltage to be applied to the first developing roller 13*d* and smaller than an absolute value of the bias voltage to be applied to the second developing roller 13*e*.

Preferably, the electrode 13*g* is arranged along axes of the first and second developing rollers 13*d*, 13*e*.

Preferably, the electrode 13*g* is in the form of wire, mesh or plate.

Preferably, the electrode 13*g* is composed of a plurality of small electrodes 131*g*, 132*g*, 133*g*, and the voltage applying unit 1 applies bias voltages each having phase which differs corresponding to each of the plurality of small electrodes 131*g*, 132*g*, 133*g*.

The entire disclosure of Japanese Patent Application No. 2008-261508 filed on Oct. 8, 2008 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus, comprising:

a photoreceptor;

a first developing roller including a plurality of magnetic poles and a first sleeve arrange rotatable to the first developing roller, the first developing roller developing the photoreceptor with a toner;

a supplying section for supplying the toner to the first developing roller;

a second developing roller including a plurality of magnetic poles and a second sleeve arranged rotatable to the second developing roller, the second developing roller arranged adjacent to the first developing roller and developing the photoreceptor with the toner supplied via the first developing roller, the second developing roller being downstream of the first developing roller, with respect to a rotational direction of the photoreceptor;

an electrode arranged between the first and second developing rollers; and a voltage applying unit for applying bias voltages each having different electric potential corresponding to the first developing roller, the second developing roller and the electrode, wherein the voltage applying unit makes an absolute value of the bias voltage to be applied to the electrode larger than an absolute value of the bias voltage to be applied to the first developing roller and smaller than an absolute value of the bias voltage to be applied to the second developing roller in order that the toner adhered to the second developing roller transfers from the second developing roller to the electrode and further transfers from the electrode to the first developing roller by an electric field.

2. The image forming apparatus of claim 1, wherein the electrode is arranged along axes of the first and second developing rollers.

3. The image forming apparatus of claim 1, wherein the electrode is in the form of wire, mesh or plate.

4. An image forming apparatus, comprising:

a supplying section for supplying toner;

a first developing roller including a plurality of magnetic poles and a first sleeve arranged rotatable to the first developing roller;

a second developing roller including a plurality of magnetic poles and a second sleeve arranged rotatable to the second developing roller, the second developing roller arranged adjacent to the first developing roller and parallel to the same;

an electrode arranged between the first and second developing rollers; and a voltage applying unit for applying bias voltages each having different electric potential corresponding to the first developing roller, the second developing roller and the electrode.

wherein an absolute value of the bias voltage to be applied to the electrode is larger than an absolute value of the bias voltage to be applied to the first developing roller and smaller than an absolute value of the bias voltage to be applied to the second developing roller, wherein the electrode is composed of a plurality of small electrodes, and the voltage applying unit applies bias voltages each having phases which differs corresponding to each of the plurality of small electrodes.

* * * * *